United States Patent [19]

Dougherty

[11] 4,045,701

[45] Aug. 30, 1977

[54] SHADOW MASK SUPPORTED BY CATHODE RAY TUBE FACEPLATE

[75] Inventor: Lawrence W. Dougherty, Sleepy Hollow, Ill.

[73] Assignee: Zenith Radio Corporation, Glenview, Ill.

[21] Appl. No.: 654,130

[22] Filed: Feb. 2, 1976

[51] Int. Cl.[2] ..... H01J 29/02; H01J 29/07; H01J 31/20

[52] U.S. Cl. ..... 313/408; 313/482

[58] Field of Search ..... 313/402, 404, 405, 406, 313/407, 408, 403

[56] References Cited

U.S. PATENT DOCUMENTS

| | | | |
|---|---|---|---|
| 2,824,990 | 2/1958 | Haas | 313/402 |
| 2,942,129 | 6/1960 | May | 313/404 |
| 2,961,560 | 11/1960 | Fyler | 313/406 |
| 3,862,448 | 1/1975 | Ishizuka et al. | 313/402 |
| 3,912,963 | 10/1975 | Sedivy | 313/402 |
| 3,921,024 | 11/1975 | Bakker et al. | 313/404 |
| 3,935,496 | 1/1976 | Gijrath | 313/402 |
| B 523,696 | 1/1976 | Groot | 313/404 |

FOREIGN PATENT DOCUMENTS

| | | | |
|---|---|---|---|
| 1,189,403 | 4/1970 | United Kingdom | 313/406 |

*Primary Examiner*—Robert Segal
*Attorney, Agent, or Firm*—John H. Coult

[57] ABSTRACT

This disclosure depicts a color cathode ray of the Shadow mask type.

A mask suspension system for establishing a predetermined spatial position of said mask relative to the inner surface of said faceplate is disclosed as comprising four suspension means for mechanically coupling the mask to the faceplate, the suspension means being located one at each corner of the mask to permit the mask to flex about said diagonals and conform to the contour of the faceplate. All four of the suspension means have means effecting a predetermined spacing of the mask from the inner surface of the faceplate. Three of the four suspension means also effect an angularly rigid and precise coupling of the mask to the faceplate. The combination is characterized by each of the three suspension means comprising an integral modification of said faceplate inner surface which defines two angularly spaced, axially convergent engagement surface areas. The mask has in each of three corner portions associated with the three suspension means, corner-located means for making angularly retentive, two-point engagement with the two angularly spaced engagement surface areas on one of the modifications of said faceplate. The resultant six-point engagement of the three corner-located means with the three integral modifications of the faceplate effect said angularly rigid and precise coupling of said mask to said faceplate. The combination also includes means for immovably holding the four mask corners on the faceplate when the tube is assembled. The mask corner portions are each structured to have high radial compliance such that upon thermal expansion of the mask, any radial loads imposed on the mask corners are purely radial and are of insufficient magnitude to significantly deform the mask.

27 Claims, 18 Drawing Figures

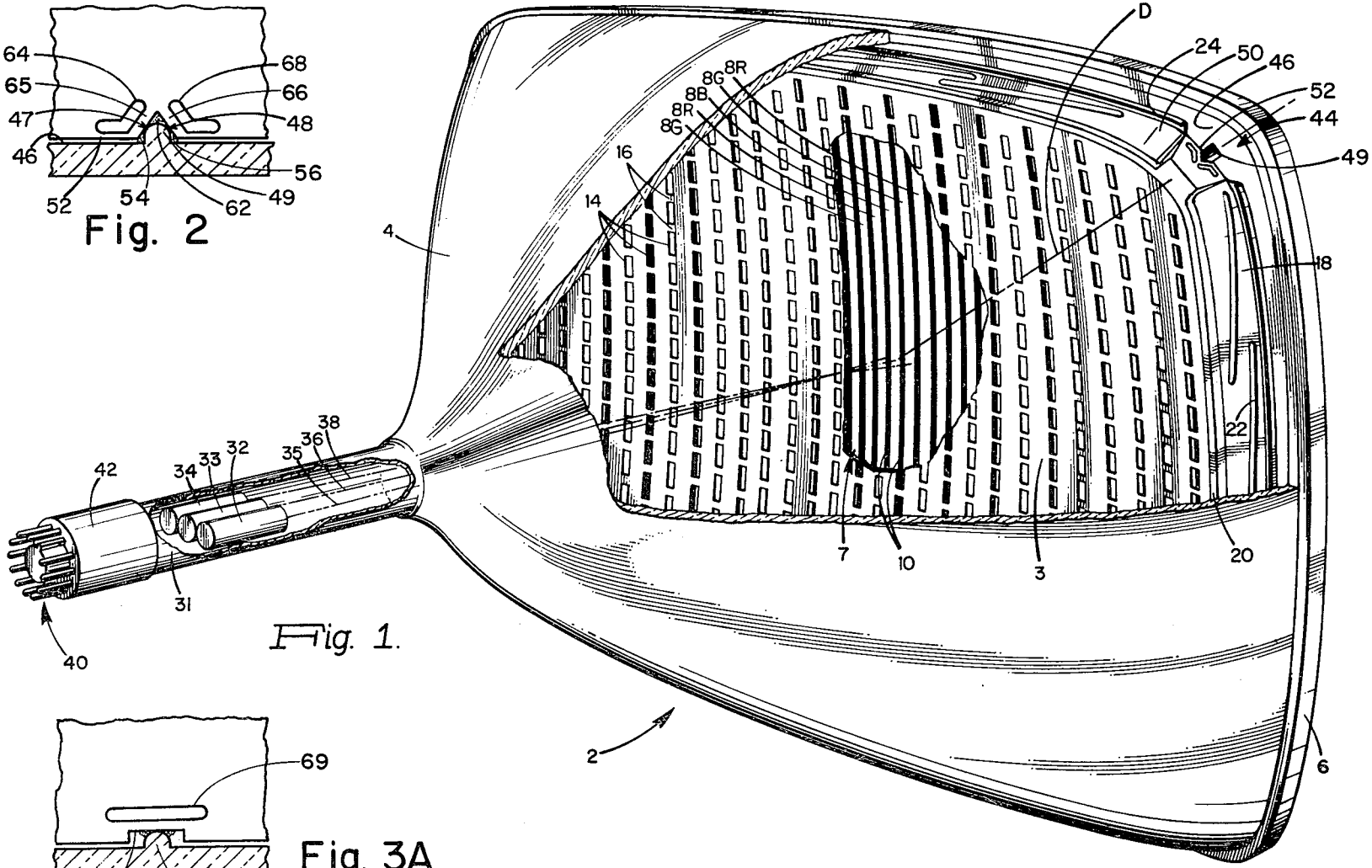
Fig. 1.
Fig. 2
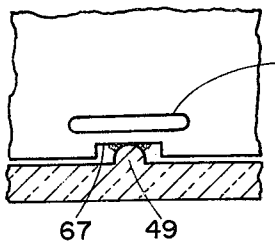
Fig. 3A

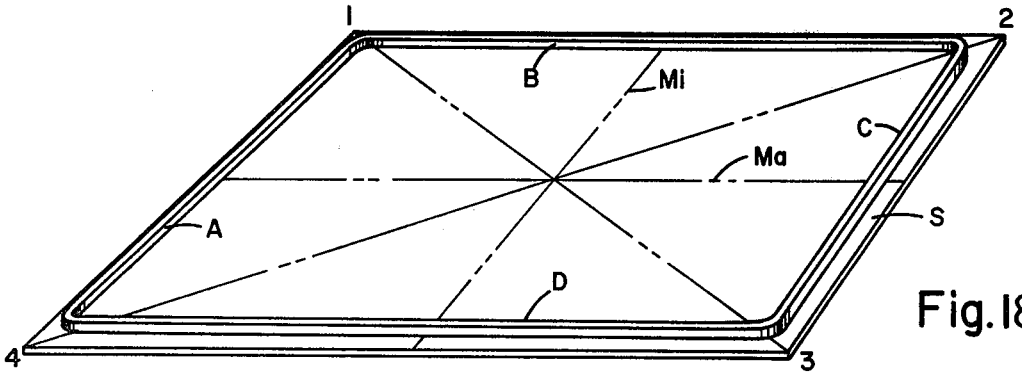
Fig.18A
Fig.18B
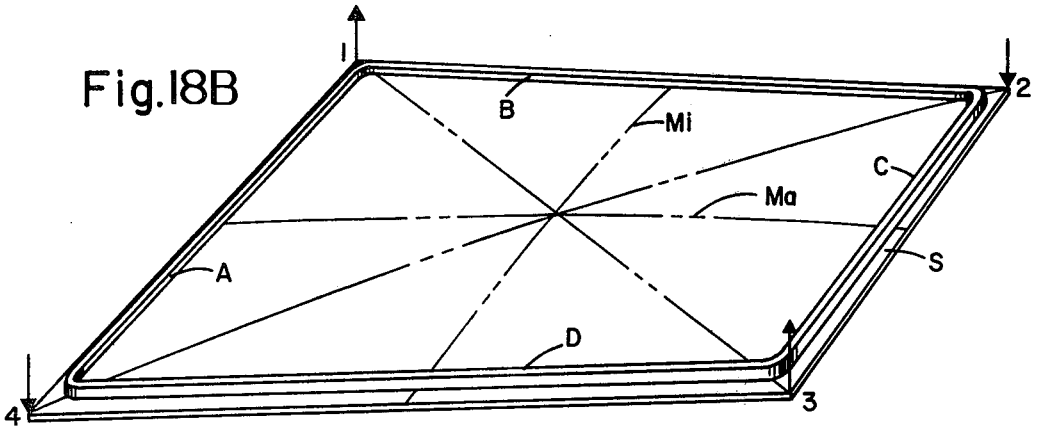
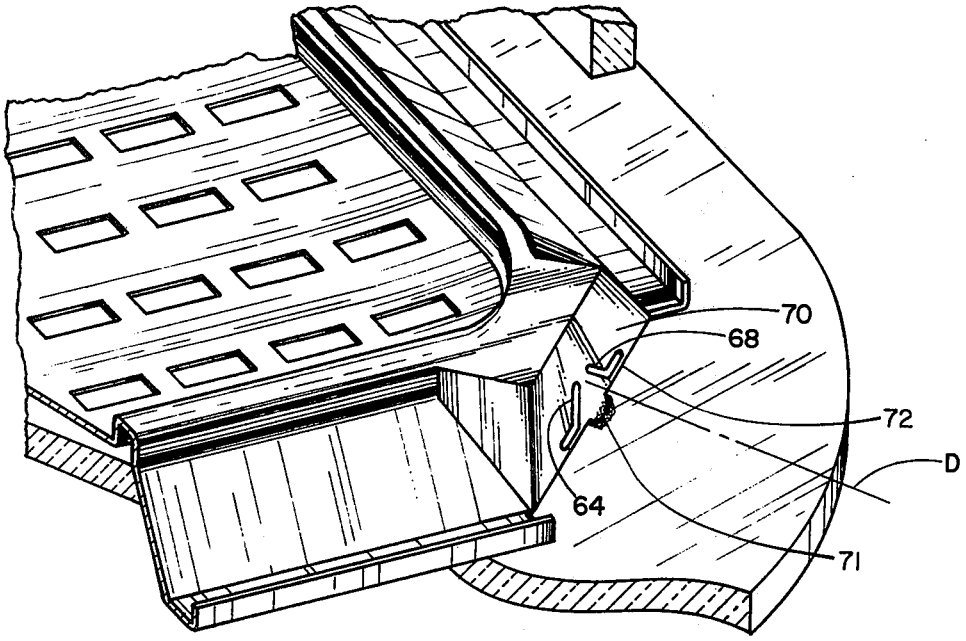
Fig. 3

SHADOW MASK SUPPORTED BY CATHODE RAY TUBE FACEPLATE

CROSS-REFERENCE TO RELATED APPLICATIONS

This application is related to, but in no way dependent upon, copending applications including Ser. No. 535,473, filed Dec. 23, 1974 (now U.S. Pat. No. 3,943,399; this application is a continuation-in-part of now-abandoned application Ser. No. 395,106, filed Sept. 7, 1973); Ser. No. 675,653, filed Apr. 12, 1976 (a second generation continuation of Ser. No. 285,985, filed Sept. 5, 1972 but now abandoned); and Ser. No. 603,984, filed Aug. 12, 1975 (now U.S. Pat. No. 3,986,072), all assigned to the assignee of the present invention.

BACKGROUND OF THE INVENTION

This invention relates to color cathode ray tubes of the type having a shadow mask, and especially to a system for mounting a shadow mask on the faceplate of a color tube. This invention has applicability to mounting systems for shadow masks of various types, including post deflection focus masks.

Conventional color cathode ray tubes have a shadow mask assembly which includes a massive frame to which is welded a dished, apertured mask. The frame is, by design, extremely rigid and provides rigidity for the mask. The mask-frame assembly is mounted in a conventional tube by a suspension system comprising three or four leaf springs which are welded to the frame at spaced points around the periphery thereof. These springs must be relatively stiff to support the heavy mask-frame assembly, typically applying a load of 4–5 pounds or more to the mask-frame assembly. The springs have apertures at their distal ends which engage studs projecting inwardly from a rearward flange on the tube faceplate. The mask-frame assembly is capable of being demounted and precisely remounted in a tube by depressing the springs to disengage the said studs. This type of system has proven to be commercially viable, however, the mask-frame assembly and its suspension system are undesirably expensive.

The invention is preferably (though not necessarily) employed in a color tube having as components a unique bulb with a flangeless faceplate and a unique corner-mounted shadow mask. In this tube, a low cost, lightweight, non-self-rigid, torsionally flexible mask is provided. The flangeless faceplate imparts the necessary rigidity to the mask. A four corner mask mounting system provides a mechanically rigid link between the faceplate and the mask and yet permits the mask to be conveniently and repeatably demounted and precisely remounted in the tube, as is required by present tube manufacturing practices.

The advantages of this tube are manifold. A primary advantage resides in the appreciable savings in bulb cost, and from the use of a lightweight, low cost shadow mask which is preferably of one-piece, frameless construction. Early versions of such a system are shown in the U.S. Pat. No. 3,912,963 and in U.S. Pat. No. 3,943,399.

A mask and mask suspension system of the nature described has imposed upon it a number of requirements and constraints not presented in conventional systems in which a rigid frame is used to impart rigidity to the mask. Before enumerating these requirements and constraints, a discussion of certain principles underlying this invention will be engaged. A shadow mask of the type with which this invention is concerned may be modeled as a rectangular four bar linkage affixed to a flexible sheet. Such a model is shown in FIG. 18A. The four rigid bars of the linkage are designated A, B, C and D; the sheet is labeled S. As is well known, a four bar linkage is not inherently a rigid structure. The rectangular four bar linkage, in its free state, might, e.g., quite easily be skewed into a parallelogram geometry. It is evident, however, that the FIG. 18A model cannot be skewed in its plane to take a parallelogram shape since it is affixed to the sheet S.

The linkage can, however, be torsionally twisted about its diagonals, as shown for example in FIG. 18B. In FIG. 18B, the model has been twisted as follows — the linkage bar A has been rotated toward the reader (see arrows); the linkage bar C has been rotated away from the reader. The corners 1 and 3 have been displaced upwardly and the corners 2 and 4 have been displaced downwardly. The sheet S is thus stressed convexly along diagonal 2-4 and somewhat concavely at the ends of diagonal 1-3. The model may thus be thought of as being twisted about one of its diagonals (here shown as diagonal 1-3). It can be noted that the model configuration, after twisting, is changed substantially less along its major axis $M_o$ and minor axis $M_i$, than along the diagonals. Thus a four bar linkage affixed to a flexible sheet is relatively stiff with respect to its major and minor axes (due to the rigidity of the bars), but is relatively flexible in torsion. When torsionally flexed (twisted), about its diagonals, the corners are displaced, but points on the major and minor axes remain relatively stationary.

As will be pointed out in more detail hereinafter, the shadow mask with which this invention is concerned is similar to the described model in its mechanical characteristics.

As suggested, the principles of this invention, though not limited to such application, are most useful when embodied in a color cathode ray tube having a flangeless faceplate. When such a faceplate is sealed to mating funnel after completion of the faceplate screening and mask insertion operation, the faceplate is very apt to experience a twist-wise elastic distortion due to a tolerance-related configurational mismatch between the funnel and faceplate sealing surfaces. Any such distortion will be rendered a permanent deformation when the sealing cement has cured and the sealing operation is completed. Thus, one of the necessary general requirements imposed on a mask and mask-suspension system intended for use with a flangeless faceplate is that it must be able to adapt to such twist-wise deformations of a faceplate with which it is mated. Stated another way, the mask must be capable of flexing or twisting about its diagonals in much the same way faceplates are apt to twist-wise deform in their contour during tube fabrication, and its suspension system must provide for such adaption. As will become evident as this description proceeds, the shadow mask and four-corner suspension system with which this invention is concerned are uniquely capable of meeting this requirement.

An important requirement imposed on such a mask suspension system is that, since the mask is non-self-rigid, the suspension system for the mask must effectively transfer the rigidity of the faceplate to the mask. That is, the suspension system must be very rigid in the tube's axial direction. Axial rigidity is also important in establishing and maintaining a prescribed position of the mask in space relative to other tube components.

Another important requirement imposed on such a suspension system is that it precisely fix and hold a predetermined spatial position of the mask as a whole relative to the faceplate against translational or rotational displacement, in spite of any thermal expansion or contraction of the mask, demounting and remounting of the mask, or mechanical shocks. It has been found that this requirement translates into a requirement that the suspension system be very stiff in the angular directions, that is, in the directions perpendicular to the faceplate diagonals and to the central axis of the tube. If the mask suspension system is not sufficiently stiff in the angular directions, the mask is apt to not always return to its bogey position (nominal assigned position) after having received a mechanical shock, or having been demounted and remounted, or after a thermal cycle. This fact is due largely to the mass of the mask, to friction at the points of engagement of the mask-mounted and envelope-mounted components of the mask suspension devices, and to the specific movements occurring with each individual insertion.

It is also desirable that any thermally induced movement of any part of the mask or of any mask suspension element during tube operation be radial, rather than angular, since radial errors can be compensated by making adjustments in the beam deflection characteristic, whereas angular errors cannot be.

It is a related and very important requirement that the mask suspension system impose as low as possible (ideally zero) radial loading on the mask. Ideally, the radial loading of the mask by its suspension system during thermal cycling of a tube-in-process and during ultimate tube operation is very low. The reason for this desired low radial loading involves the mechanical construction of the mask. The unique mask with which this invention is associated does not have the conventional heavy, rigid supporting frame, but rather is deliberately caused to be of low mass and somewhat flexible, particularly in torsion. It has been found that a too-high radial loading of the mask is apt to cause radial compression of such a mask, resulting in radially inward registration shifts during thermal processing of the tube and/or during tube operation. This problem has been found especially severe if the mask is manufactured by a method wherein it is preformed before it is etched. The etching process causes the mask to lose a substantial part of its stiffness. If a high radial loading is imposed on such a mask, the mask is apt to take a different contour after etching than it had before etching.

A major motivation behind the development of the unique tube described is to reduce the cost of tube manufacture. It is therefore an extremely significant object that the mask suspension system be as inexpensive as possible.

The referent copending applications and patents depict a number of highly successful approaches to meeting the afore-described requirements and constraints on mask suspension systems of the nature described. The referent copending application Ser. No. 675,653 describes a system in which cost reduction in the mask suspension system is effected by forming integral, radially oriented modifications of the faceplate glass in the faceplate corners which make six point engagement with mounting elements on the mask corners. The present invention utilizes the teaching of that application (of providing an integral radial modification of the faceplate) in the interest of cost reduction, but is believed to be an improvement over the system described in that application by reason of a construction which makes possible further economies, and which has other advantageous properties, which will become evident from the ensuing description of this invention.

A second approach is described and claimed in the referent U.S. Pat. No. 3,986,072. According to the teaching in that patent, a mask suspension system is provided which utilizes a stud affixed to the tube envelope in each corner thereof which engages a mask-mounted component on the corner of the mask. Either the envelope-mounted component or the mask-mounted component employs a cantilevered leaf spring which is extremely stiff in the angular and axial directions. According to the teaching of the said patent, the spring applies a relatively low load on the mask; however, it has been found that for a variety of reasons, it is not without some effort that the relatively low loading of the mask is established and maintained.

It is another object of this invention to provide a system lower in manufacturing cost than the system described in the said U.S Pat. No. 3,986,072.

As is evident from the above, I do not claim to be the first to conceive of the idea of suspending a lightweight, flexible shadow mask for a color CRT by means of integral modifications of the inner surface of the supporting faceplate which make six point contact with elements spaced around the mask. As noted above, a system along these general lines is described in the referent application Ser. No. 675,653. Also, U.S. Pat. Nos. 2,961,560 — Fyler, 3,038,096 — Knochel et al., 3,824,989 — Christofferson, 2,932,241 — Haas, and 2,824,990 — Haas, each show color cathode ray tubes having a mask suspension system in which a lightweight, flexible mask is supported on the inner surface of a color CRT faceplate by integral glass protuberances which project from the faceplate and make positional engagement with V-channels formed in or attached to the shadow mask. None of these references discloses a four-corner suspension system; rather, each discloses an arrangement of supporting the shadow mask relative to the faceplate at the conventional locations around the periphery of the faceplate. However, as apparently recognized by certain of those patentees, such a support system, when used with a flexible mask, is unsatisfactory unstable. Accordingly, other points of mask supports are provided, apparently to stabilize an otherwise unstable mask.

In the prior U.S. Pat. No. 2,961,560 to Flyer, engagement of the V-channel structure on the mask with the integral protuberance on the faceplate is intended to permit a frictional sliding engagement of the V-channel over the protuberance as the mask expands and contracts during heating and cooling. As taught by Fyler (see col. 3, lines 17 et seq. and col. 5), if such provision is not made, thermal expansion and contraction of the mask will deform the mask and result in loss of beam-phosphor registration. The patents to Knochel et al and the Haas patents disclose systems which are similar to that of Fyler in the sense that V-channels on the mask are supported by rounded protuberances on the faceplate — yet no mention is made of compensation for such thermal expansion and contraction of the mask. The inevitable conclusion is that, since the patents are presumed to describe operative structures, the Haas, Christofferson and Knochel et al systems must also provide for relative movement of the V-channels and supporting posts as the masks in their systems expand and contract. From my working experience, however, it is clear that such an arrangement would be inoperative since the sliding frictional engagement between mask and faceplate would not result in precise positioning of the mask relative to the faceplate. As a mask such as taught by the Fyler, Knochel et al. or Haas patents would expand, the contact point between the V-channel and the mating glass protuberance would change. Due to the inevitable manufacturing tolerances in mask and glass manufacture, as the contact point would change, the position of the mask relative to the faceplate would shift, resulting in beam-phosphor registration errors.

In addition, it is believed that any system which requires six-point hold-down of the mask (Fyler), or ten-point hold-down as in Knochel et al., or five-point hold-down as apparently shown by Haas, is an unworkable structure due to the distortion of the mask required to make engagement with the large number of support points around the periphery of the faceplate. Also, each of the described patent systems is believed to be commercially unacceptable for cost reasons alone.

| Other Prior Art | | |
|---|---|---|
| U.S. | | British |
| 2,222,197 | 3,484,638 | 1,278,633 |
| 2,733,366 | 3,497,746 | 1,278,634 |
| 2,823,328 | 3,521,104 | 1,278,635 |
| 2,906,904 | 3,529,198 | 1,172,334 |
| 2,916,644 | 3,537,159 | |
| 2,922,063 | 3,548,235 | |
| 3,350,593 | 3,639,799 | |
| 3,404,302 | 3,700,949 | |
| 3,450,920 | 3,735,179 | |

OBJECTS OF THE INVENTION

It is a general object of this invention to provide a color cathode ray tube having an improved corner suspension system especially useful for corner-suspending a low cost, non-self-rigid, torsionally flexible shadow mask adjacent to the tube's faceplate.

it is another object of this invention to provide an improved corner suspension system for a non-self-rigid shadow mask which is very stiff in the faceplate angular direction and in the direction of the central axis of the tube and which imposes at most a very low radial loading on the mask which is insufficient to significantly deform the mask. It is thus an object to provide a suspension system which precisely fixes and holds a predetermined spatial position of the mask relative to the faceplate position against translational, rotational and axial displacement, in spite of any thermal expansion or contraction of the mask during processing or operation of the tube, demounting and remounting of the mask, or mechanical shocks.

It is still another object to provide an improved mask suspension system for a color CRT shadow mask which utilizes integral faceplate and mask formations to achieve mask suspension, as suggested by the afore-described Haas, Fyler, Christofferson, and Knochel et al. systems, and yet which is not plagued by the described shortcomings inherent in those systems.

It is another object to provide a shadow mask suspension system which suppresses microphonic effects (vibration-induced picture degradation).

It is another object to provide such a mask suspension system in which the constituent suspension devices are extremely compact and unobtrusive and are thus particularly suited for corner-mounting a shadow mask.

It is yet another object to provide a mask suspension system having the afore-described qualities and yet which is relatively very inexpensive.

BRIEF DESCRIPTION OF THE DRAWING

The features of the invention which are believed to be novel and unobvious are set forth with particularity in the appended claims. The invention, together with further objects and advantages thereof, may be best understood by reference to the following description taken in connection with the accompanying drawings, in which:

FIGS. 18A and 18B are schematic diagrams of a four-bar linkage model useful in understanding the mechanical properties of a shadow mask of the type with which this invention is concerned.

FIG. 1 is a perspective view, partly broken away, of a novel color cathode ray tube as seen from the rear, with a portion of the envelope cut-away to reveal a shadow mask and suspension system thereof which implement the principles of this invention.

FIG. 2 is an enlarged fragmentary side view of a suspension device shown in FIG. 1 — a device employed in three of the four mask corners;

FIG. 3 is an enlarged fragmentary perspective view, shown partly sectioned and broken away, of a corner of the tube not shown in FIG. 1, revealing with particular clarity a suspension device for mounting the fourth corner of the shadow mask;

FIG. 3A is a view of an alternative embodiment of the fourth corner suspension means shown in FIG. 3;

DESCRIPTION OF THE PREFERRED EMBODIMENT

Figure 4:
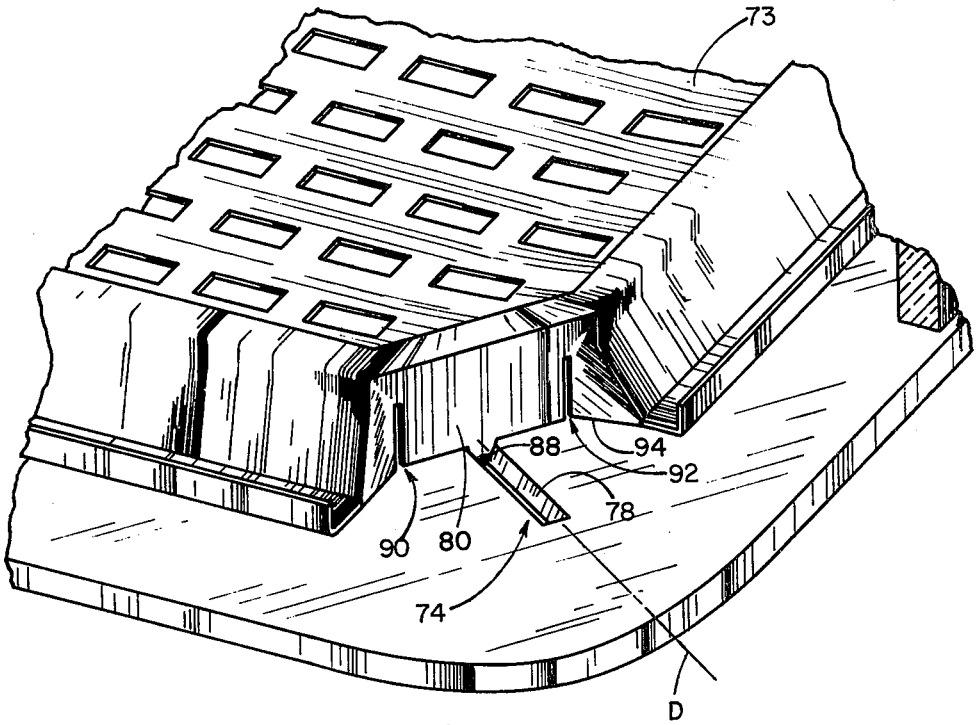
FIGS. 4 and 5 are perspective and elevational views of a mask suspension means representing an alternative to the FIG. 2 device.

This invention is directed to providing an improved shadow mask suspension system which is especially useful for suspending upon the envelope of a color cathode ray tube a lightweight, torsionally flexible shadow mask such as is described and claimed, for example, in the referent U.S. Pat. No. 3,912,963. As used herein, the term "shadow mask" is intended to encompass all tubes, including post deflection focus ("PDF") tubes, in which a color selection mask or electrode achieves a shadowing effect, whether total or only partial (as in PDF tubes). The present suspension system includes four suspension devices, one on at each corner of the mask. The general concept, however, of a lightweight, non-self-rigid, torsionally flexible, rectangular shadow mask which is supported at is four corners so as to permit it to conform to the contour of a cathode ray tube faceplate was first described and claimed in the above-noted copending application of K. Palac, Ser. No. 285,985.

FIGS. 1–3 illustrate a color cathode ray tube 2 incorporating a mask suspension system which implements the principles of this invention. The tube 2 is depicted as having an envelope comprising a funnel 4 sealed to a rectangular flangeless faceplate 6. The tube 2 includes a lightweight, rectangular, non-self-rigid, torsionally flexible shadow mask 3 of novel character described in detail and claimed in the referent U.S. Pat. No. 3,912,963.

The illustrated tube 2 is shown as having on the inner surface of the faceplate 6 a phosphor screen 7 (see FIG. 1). The screen is illustrated as comprising an array of vertically oriented, horizontally repeating triads of red-emissive, blue-emissive and green-emissive phosphor elements 8R, 8B and 8G. As illustrated, the screen may be of the negative guardband, black matrix type as taught in U.S. Pat. No. 3,146,368. A black grille 10 comprises in this embodiment a pattern of light-absorptive bands separating the phosphor elements 8R, 8B and 8G.

The shadow mask 3 has a pattern of "slot" or "slit" apertures 14, spaced by "tie-bars" 16, which define the beam landings on the screen (not shown). Briefly, the shadow mask 3 is non-self-rigid and may conveniently be of a frameless, one-piece construction metal-formed from a single sheet of electrically conductive materials such as 6 mil thick, cold-rolled steel. An integral skirt 18 shields the screen 7 from stray and overscanned electrons. The skirt 18 and integrally formed channel 20 and edge lip 24 enhance the stiffness of the mask with respect to its major and minor axes, while permitting the mask to flex with respect to its diagonals and thereby conform, when mounted, to the contour of the faceplate.

The tube is shown as including a neck 31, within which is contained an electron gun assembly. The electron gun assembly may take any of a variety of constructions, but in the illustrated embodiment wherein the mask is a slot mask cooperating with a screen of the "line"-type, the electron gun assembly preferably is of the "in-line"-type, comprising three separate guns 32, 33, 34 generating three coplanar beams 35, 36, and 38 which carry, respectively, red-associated, blue-associated and green-associated color video information. The electron gun assembly is electrically accessed through pins 40 to the base 42 of the tube.

A mask suspension system constructed according to this invention will now be described. FIGS. 1 and 2 show a preferred mask suspension means or device 44 which may be employed on three of the four corners of the mask 3. As will be explained in more detail below in connection with FIG. 3, the device for the fourth corner must hold the proper "Q" spacing (the spacing between the apertured region of the mask and the screen-bearing faceplate surface), while allowing the fourth corner of the mask to seek an equilibrium position in its own plane. The requirements on the fourth corner device are thus somewhat different than for the other three devices, permitting the fourth device to be of somewhat different construction, as will be explained.

The illustration mask suspension device 44 includes envelope-associated means on the tube faceplate. As explained above, a shadow mask suspension system for suspending a non-self-rigid, torsionally flexible mask as described has a number of important requirements imposed upon it: the suspension system should be very rigid in the angular and axial directions; it should precisely fix and hold a predetermined spatial position of the mask relative to the face-plate and prevent translational, rotational, and axial displacement thereof, in spite of thermal expansion or contraction of the mask during tube operation or fabrication, and in spite of demounting and remounting of the mask or mechanical shocks.

It is also very important that upon thermal expansion of the mask, any radial loads exerted on the mask not be of sufficient magnitude to significantly deform the mask. Another extremely important requirement is that the mask suspension system have a low manufacturing cost. As will become evident from the following description, the shadow mask suspension system of this invention, like those described above upon which it is an improvement, also must be capable of suspending the mask such that it can flex about its diagonals and conform to the contour of the faceplate. This is accomplished by the unique corner mounting of the mask.

It is an object of this invention to provide a mask suspension system which is capable of meeting the afore-stated requirements and yet which is improved in certain respects. A first improvement lies in the cost reduction effected by the structure of the present mask suspension system. A second improvement lies in the enhanced angular and axial rigidity which is achieved by the present mask suspension system. A third improvement lies in the very low radial loads which are imposed on the mask during thermal expansion thereof. These improvements will become evident from the ensuing description.

A mask suspension system in accordance with the teachings of this invention is illustrated clearly in FIGS. 1 and 2 which show a mask suspension means or device 44 at one of the four corners of the mask. As will be described in more detail hereinafter, three of the four mask corners are suspended by devices as shown at 44; the fourth corner has a somewhat different suspension device, illustrated in FIG. 3 (to be described later).

Each of the mask suspension devices 44 has an envelope-associated component and a mask-associated component. In accordance with a preferred embodiment of this invention, the envelope-associated component comprises a radially oriented integral modification of the inner surface 46 of the faceplate. The integral modification defines two engagement surface areas 47, 48 which are spaced angularly (i.e., angularly as opposed to radially) on the faceplate. The engagement surface areas 47, 48 extend radially on the faceplate, and are convergent axially, i.e., in the direction of the central axis of the tube 2. As will become evident hereinafter, the direction of convergence may be forwardly or rearwardly.

The mask preferably has the mask skirt 18 formed integrally therein. In each of three skirt corner portions corresponding to the said three mask suspension devices 44, there is included a mask suspension element, preferably integral, for making an angularly retentive, two point engagement with the engagement surface areas 47, 48 on the integral modification of the faceplate 6. The resultant six point engagement of the three mask elements with the three integral modifications in the said three corners of the mask effect an angularly rigid, precisely reseatable coupling of the mask of the faceplate.

In the illustrated FIGS. 1–2 embodiment, the integral modification of the faceplate inner surface is shown in the form of a boss 49, here shown as taking the shape of a ridge. The boss 49 shown as having an arcuate cross-sectional configuration, however, other structures defining two angularly spaced, axially convergent, preferably radially extending, engagement surface areas would be acceptable. For example, a boss having V-shaped or flat oval cross-sectional configuration would be acceptable. The radially inward end of the boss 49 preferably has a gradual taper (not shown) to prevent splash-back of phosphor slurry onto the viewing area during screening of the faceplate.

In the illustrated FIGS. 1–2 embodiment, the skirt corner portion is designated 50. The skirt corner portion 50 is illustrated as including a mask suspension element 51, preferably integrally formed for cost reasons. The skirt corner portion is shown as defining a knife-like free edge 52 which in turn includes two angularly spaced edge elements 54, 56 for making two point engagement with the engagement surface areas 47, 48 on the boss 49. The edge elements 54, 56 may, alternatively, be defined by otherwise suitably configuring the free edge 52. Forming the edge elements integrally with the mask has the advantage that the problem of tolerance accumulation inevitably attending designs which require separate mounting brackets, springs, etc., is absent.

It can be seen that because the engagement surface areas 47, 48 on the boss 49 are angularly spaced in three corners of the mask 3, the resultant sixpoints of engagement between the mask and faceplate will very accurately fix and determine the spatial location of the mask relative to the faceplate inner surface, and will produce a very precise reseatability of the mask during tube fabrication, irrespective of the number of mask withdrawals from the reinsertions into the tube.

In order to immovably hold the mask to the faceplate when the tube is finally assembled, more specifically, in order to hold the mask corner portion on the boss 49, any of a number of securing means may be employed. The one illustrated in the present embodiment is a quantity of cement 62. The cement may be selected from a variety of suitable cements — e.g., frit cement (a devitrifying solder glass commonly used to hermetically seal the faceplate and funnel of color cathode ray tubes), hydraulic setting compounds, or sodium silicate or potassium silicate (washer glass). The requirements of the cement are that it be capable of surviving the thermal cycles experienced during tube fabrication, that it not emit gases nor degenerate in any way which could cause injury to the tube, and that it be stable and maintain its adhesive integrity over the life of the tube. The cement must not be susceptible to fracture upon being subject to mechanical shocks, which may in practice reach as much as 40, 50 or even 100 G's. The cement must be able to withstand thermal cycling of the tube during which the mask will expand and exert some force on the cement. This latter requirement is minimized by the present invention, as will now be described.

As noted, since the mask 3 is relatively weak, it is desirable that the mask suspension not exert an unacceptably high radial loading on the mask during thermal cycling of the tube or during tube operation. An unduly high radial loading on the mask upon thermal expansion thereof would change its contour with resulting impairment of the accuracy of registration on the screen between the electron beam landings and the impinged phosphor elements.

To this end, and in accordance with an aspect of this invention, the said three mask corner portions (in this preferred embodiment the three skirt corner portions 50) are structured to have high radial compliance, i.e., to flex easily in the radial direction, when the mask expands thermally. In the FIGS. 1–2 embodiment, to produce this effect, the skirt corner portions are each caused to be structurally weakened. This structural weakening of the skirt corner portion 50 is preferably accomplished, as shown, by having mask material removed from the skirt corner portions. More specifically, as shown in FIGS. 1 and 2, the skirt corner portions 50 each have an aperture pattern formed therein to effect said structural weakening thereof. In FIGS. 1–2, two apertures 64 and 68 are formed in the skirt corner portion around the mask suspension element 51. Whereas the arrangement of apertures shown at 64 and 68 is preferred, as will be described hereinafter, other ways to achieve the said structural weakening of the mask corner portions by material removal (or otherwise) may be utilized.

The apertures 64, 68 may be die-formed in the mask at the time the mask is shaped, or may be made at another suitable time as by a photoetching process. Because the mask skirt acts as an electron shield, the apertures 64, 68 should not be made any wider than necessary.

As will become evident as other embodiments of this invention are described, in accordance with preferred executions of this invention, to provide high radial compliance in the mask corner portions, the skirt corner portions each include at least one resilient strip-like section. In the FIGS. 1–2 embodiment one section is designated 65 and another 66. The strip-like sections 65, 66 have as side edges the edge elements 54, 56 and have as the opposed side edges the boundaries of apertures 64, 68, respectively. It can be seen that the sections 65, 66 will act like springs, flexing as the mask expands and contracts to insure that no radial loads significant to deform the mask will be imposed thereon.

In order that the radial compliance of the mask corner portions is purely radial, as is preferred, the strip-like sections are desirably located on the mask corner portion symmetrically with respect to a mask diagonal, as shown.

As mentioned above, the mask suspension device for the fourth corner has requirements imposed upon it which are somewhat different from the requirements imposed upon the mask suspension devices for the other three corners. It should be kept in mind that the fourth corner suspension device is redundant. That is to say that the position of the mask in the plane of the mask is determined by the remaining three corners. The fourth corner must, in effect, not interfere with the spatial placement of the mask as determined by the remaining three mask suspension devices. However, the fourth corner must, of course, determine a correct Q-spacing for the fourth corner of the mask, that is a correct distance between the mask central portion and the inner surface of the faceplate. To this end, as shown in FIG. 3, the corner skirt portion 70 for the fourth corner defines a free edge 72 with an element 71 whose configuration is related to the mask suspension devices in the remaining three mask corners such as to maintain a predetermined spacing of the mask from the faceplate.

In the illustrated embodiment, the inner surface of the faceplate in the fourth corner has no radial modification. The element 71 on the free edge 72 is cemented, but before the cement sets it is free to slide on the concave inner surface of the faceplate, thus permitting the spatial position of the mask to be dictated by the other three suspension means. When the cement sets, the high radial compliance provided by the apertures 64, 68 prevents distortion of the mask upon thermal expansion thereof.

In an alternative to the FIGS. 1-3 embodiment, the faceplate may have four bosses as shown at 49 — one in each corner. Such an alternative is illustrated in FIG. 3A. The proper Q-spacing at all corners would be provided by such bosses, and the protuberant element 71 would be replaced by a straight-edged recess 67, as shown, or merely a straight free edge of the mask skirt. A slit 69 in the mask skirt gives the fourth corner the desired high radial compliance.

The three-boss version has the advantage, however, that wrong-way mounting of the mask (i.e., in a 180°-misplaced orientation) would be difficult if not impossible. An attempt to mount the mask in the 180°-misplaced orientation would result in the protuberant element 71 being perched unstably on top of one of the bosses 49 — indicating clearly a wrong-way mount.

An advantage of the mask suspension system of this invention not heretofore discussed is its ability to suppress microphonics. "Microphonics" is a term of art in the color CRT industry which is used to refer to picture-degrading effects that can result when a color tube is vibrated or shocked. If the shadow mask in a shadow-mask type color tube is suspended by a too-compliant suspension system, when the tube receives a shock, the mask will vibrate with the result that degradation of the reproduced picture colors will result.

The system of this invention provides an extremely stiff support for the mask in the axial and angular directions (the directions that matter with regard to microphonic effects), and microphonic effects are suppressed to a low level compared with conventional mask suspension systems.

Before continuing, I will discuss ways in which my invention differs from the systems disclosed by the aforementioned prior art patents. One of the chief differences between the present invention and the systems disclosed by those patents is in the underlying concept of how thermal expansion and contraction of the mask is accommodated. In the prior art patents, a V-channel formed in or carried by the shadow mask is urged by a spring down against an integral protuberance extending from the faceplate inner surface. The theory of operation involves the notion that upon expansion of the shadow mask during thermal cycling of the tube or when the tube is operating, the V-channels will slide radially on the engaging glass protuberances. When the mask is heating, the V-channels will slide radially outwardly; when the mask is cooling, the V-channels will slide radially inwardly. As noted, as a result of the variations in the contour of the V-channels and/or the glass protuberances, unacceptable errors in the position of the shadow mask relative to the faceplate will result.

In marked contrast to those systems, the present invention is predicted on the principle that sliding frictional engagement of the mask with a supporting glass structure is not feasible. Rather, the mask is affixed at its four corners to the faceplate to preclude any possible relative movement between mask and faceplate. Thermal expansion and contraction of the mask is accommodated by the provision of high radial compliance in the corner portions of the mask. The flexible of the mask corner portions as the mask expands or contracts has the desired effect that any radial loads imposed on the mask are of insufficient magnitude to significantly deform the mask. As noted also, any loads imposed on the mask are preferably purely radial and oriented along a mask diagonal.

As suggested above, it is conventional to fabricate the mosaic phosphor screen for a color CRT by employing a photo-screening operation using the shadow mask as a photographic stencil. The shadow mask is inserted into the tube and removed therefrom a number of times during the photo-screening operation. Each time the mask is remounted in the tube, it must, of course, assume the same position with respect to the faceplate as it had before. The mask suspension system according to this invention provides the necessary accuracy and repeatability in the positioning of the mask relative to the faceplate, as described above. Whereas the mask has been described as being cemented to the faceplate, this, of course, is done only after the faceplate has been screened and the tube is in final assembly.

During the photo-screening operation the mask must be mountable in such a way that it can be readily demounted. Conventional photo-screening operations are carried out with a screening lighthouse in which the faceplate is supported in a face-up position during exposure, i.e., the mask is hanging from and situated below the faceplate. Such an approach would not be feasible, however, with the mask suspension system of this invention, since it would fall from the faceplate under the force of gravity.

Therefore, in order to accomplish photo-screening of a faceplate using the shadow mask suspension of this invention, non-conventional means must be employed. One straight-forward approach is to use an inverted lighthouse in which the faceplate is supported concave side up with gravitational forces being employed to hold the shadow mask on the faceplate. A lighthouse along the lines described is disclosed in the above-discussed patent to Hass — U.S. Pat. No. 2,932,241. It may be necessary to add small weights at the points of mask engagement with the faceplate to ensure four-corner engagement therewith.

Figure 5:
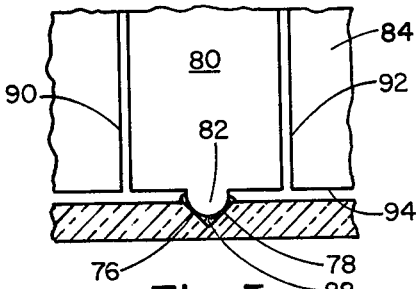

A second embodiment of the invention is illustrated in FIGS. 4 and 5. The FIGS. 4-5 embodiment teaches a number of things not taught explicity in the FIGS. 1-2 embodiment. First, the integral modification of the faceplate 6 is shown as taking the form of a groove 74, rather than a boss. The groove surfaces 76, 78 constitute the radially extending, axially convergent, angularly spaced engagement surface areas. Also, in the FIGS. 4-5 embodiment, the mask suspension element takes the form of a cantilevered blade 80 on the end of which is an arcuately shaped spade 82 making two-point engagement with the surfaces 76, 78 of the groove 74. As in the FIGS. 1-2 embodiment, the six points of engagement established by the mask suspension means or devices in three of the corners of the construction shown in FIGS. 4-5 fix and determine the spatial position of the mask 84 relative to the inner surface of the faceplate. As in the FIGS. 1-2 embodiment, a cement 88 may be employed to hold the blade 80 in the groove 74. The cross-sectional configuration of the groove may take the other shapes suggested for the boss 49. For example, the groove 74 may have an arcuate or oval cross-section. The spade 82 may also have other suitable profiles. The blade 80 should be sufficiently wide that a high degree of tangential stiffness is present.

The desired low, purely radial loading of the mask is accomplished in the FIGS. 4-5 embodiment by the provision in each of the skirt corners of a pair of angularly spaced slits 90, 92, one on each side of the spade 82. The slits 90, 92 extend radially inwardly from the knife-like free edge 94 of the mask skirt and effect a structural weakening of the skirt corner portion. The mask 84 may be formed from a sheet material such as 6 mil steel. By appropriately selecting the length and spacing of the slits, the mask corner portions are given the desired high radial compliance in order that upon thermal expansion of the mask, an acceptably low radial loading of the mask is produced.

Preliminary tests have shown that in an embodiment such as depicted in FIGS. 4–5, the blade 80 may, for example, be about ½ inch long and ½ inch wide, assuming the use of 6 mil steel as the material for the mask. The FIGS. 4–5 embodiment is intended for use in three of the four corners of a mask 84. For reasons given above, the fourth corner suspension means would not have the groove 78 and the spade 82 would have reduced extension. The spade 82 would be cemented in the fourth corner, as well as in the remaining three corners.

Whereas the FIGS. 4–5 embodiment does show an alternative execution of the invention, the FIGS. 1–2 embodiment is preferred from a number of standpoints. In the FIGS. 1–2 embodiment, the recess in the free edge 52 defined by edge elements 54, 56 is within the compass of the mask skirt 18 and is therefore protected during handling of the mask. Secondly, in the FIGS. 1–2 embodiment, the boss 49 will not be filled with phosphor material during screening of the faceplate, as the groove 74 in the FIGS. 4–5 embodiment is apt to be. On the other hand, the FIGS. 4–5 embodiment is preferred from the standpoint that a groove holds cement better than a boss.

Still other embodiments of the invention are envisioned. For example, a blade-type mask suspension element as shown in FIGS. 4–5 could be provided, but with a notch rather than an extension formed therein. In three of the mask corners, the notch would cooperate with a boss, such as boss 49, formed integrally in the faceplate inner surface. In the fourth corner, the notch would be missing; a structure utilizing the principles depicted in FIGS. 3 or 3A could be employed.

Figure 6:
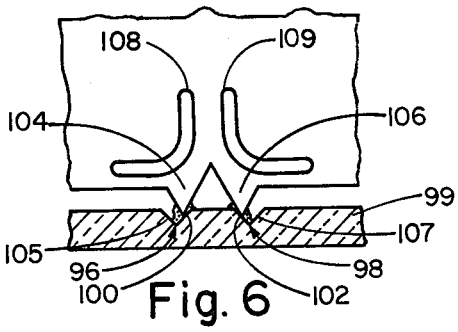

Yet other embodiments of the invention are contemplated. For example, FIG. 6 illustrates an embodiment of the invention wherein two radially oriented, axially extending grooves 96, 98 are formed integrally in the inner surface of the faceplate 99. The surfaces 100, 102 constitute radially extending, angularly spaced, axially convergent engagement surface areas.

The mask suspension element 103 in the FIG. 6 embodiment defines a pair of edge elements in the form of tips 104, 106 of a bifurcation, which tips engage the surfaces 100, 102. (The tips could as well be spaced to engage the axially forwardly convergent surface areas 105, 107). As in the aforediscussed embodiments, other configurations of the grooves 96, 98 and edge elements engaging the groove surfaces could be employed.

The FIG. 6 embodiment also teaches that the aforedescribed high radial compliance (low stiffness) of the mask corner portions can be achieved by forming in the skirt corner portions aperture patterns other than the two-aperture pattern shown in FIGS. 1–2. In the FIG. 6 embodiment, a pair of boomerang-shaped apertures 108, 109 is employed. Between the aperture 108, 109 and the tips 104, 106 are formed resilient strip-like sections which function like the strip-like sections discussed above.

Figure 7:
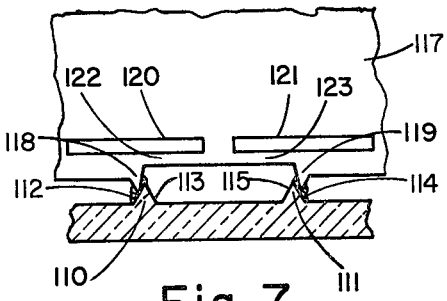
FIGS. 6–15 illustrate ten other mask suspension means representing other implementations of the principles of the invention.

FIG. 7 discloses another embodiment in which the integral radial modifications on the inner surface of the faceplate take the form of a pair of angularly spaced ridges 110, 111. The radially extending, angularly spaced, rearwardly axially convergent, engagement surface areas are in this embodiment the surfces 112, 114. Alternatively, the forwardly convergent surfaces 113, 115 could be employed. The skirt corner portion 117 of the mask defines integral triangular projections 118, 119 which engage the said surfaces 112, 114 (or alternatively, surfaces 113, 115).

The skirt corner portion has formed integrally therein an aperture pattern in the form of a pair of slits 120, 121 which, together with the free edge of the mask skirt, form resilient strip-like sections 122, 123. As in the above FIGS. 1–3 and FIG. 6 embodiments, the strip-like sections cause the skirt corner portion to have high radial compliance. The slits could be extended and merged to form a single slit for greater radial compliance, if such is desired, however, the trade-off would be in lost axial stiffness. Remember that by this invention there is provided mask suspension systems whose stiffness in the angular and axial directions is high, but whose stiffness in the radial direction is very low (i.e., whose radial compliance is high).

The FIGS. 6 and 7 embodiment, have the advantage relative to the FIGS. 1–2 embodiment, for example, of employing integral faceplate modifications of reduced depth or height. With respect to the FIG. 7 embodiment — (ridges 110, 111) of reduced height are less apt to reflect phosphor slurry back onto the critical screen areas during the faceplate screening operation than bosses of greater height.

Figure 8:
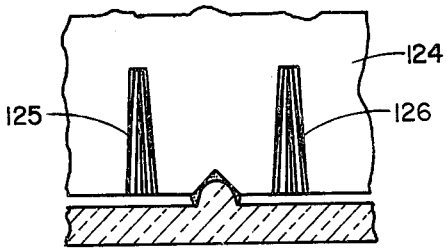

It is also contemplated that ways other than by material removal may be employed to achieve the desired high radial compliance in the mask corner portions. For example, the sheet material of the skirt corner portions may be thinned, or in any other suitable way structurally weakened to the extent that upon thermal expansion of the mask, radial loading of the mask sufficient to significantly deform it will be precluded. FIG. 8 depicts an embodiment wherein the skirt corner portion 124 has a pair of angularly spaced corrugations 125, 126 for effecting the said structural weakening thereof. In this embodiment the axial stiffness is very high, but the trade-off is in terms of lost radial compliance and angular stiffness.

Figure 9:
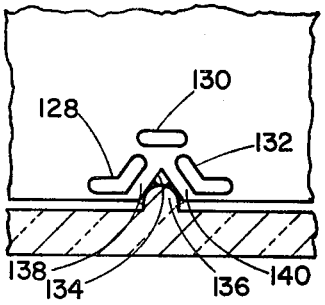

FIG. 9 illustrates a corner suspension device representing yet another embodiment of this invention. The FIG. 9 embodiment is a predecessor to the now-preferred FIGS. 1–2 embodiment. The aperture pattern in the mask corners in the FIG. 9 embodiment comprises apertures 128, 130 and 132.

A system designed to have the aperture pattern shown in FIG. 9 was constructed and successfully tested. That system had the following specifications. The aperture 130 was approximately 5/16 inch long and 3/16 inch wide. The apertures 128 and 132 were each about ¼ inch long and also about 3/16 inch wide. The apertures 128 and 132 were separated from the aperture 130 by about 3/64 inch.

The V-notch 134 was approximately 9/32 wide at the base and each of its sides subtended an angle of about 55 degrees with repsect to the bottom edge of the skirt. It is noted in this connection that too large a notch angle provides "soft" or ill-defined angular locating, whereas too small an angle results in poor control over "Q" positioning.

The mask of which the FIG. 9 corner portion was a part was composed of 6 mil cold-rolled steel. Glass bosses 136 in all four corners were simulated for the experiment by cementing onto a faceplate portions of glass rods.

Tests using mask suspension devices as shown in FIG. 9 and described above demonstrated that the aperture 130 was probably not necessary. It was also learned that the apertures 128 and 132 should be extended parallel to the inner surface of the faceplate such that the resilient strip-like sections 138, 140, respectively, formed between the apertures 128, 130 and the free edge of the skirt portion would provide a desired higher radial compliance for the mask corner portion. Thus, the FIGS. 1–2 embodiment evolved from the successful construction and testing of the embodiment fabricated as shown in FIG. 9.

Another embodiment (not shown) similar to the embodiment shown in FIGS. 1–2 could be constructed, having the apertures 64, 68 merged over the notch to form a single hat-shaped slit. It will be recognized in comparing this embodiment with the FIGS. 1–2 embodiment, that it would provide a single resilient strip-like section, rather than a pair of shorter sections, with the result that it would have higher radial compliance than the FIGS. 1–2 embodiment. It will also be recognized, however, that by merging the apertures 64, 68 in the FIGS. 1–2 embodiment, the axial stiffness of the skirt portion in the mask corner is reduced.

Figure 10:
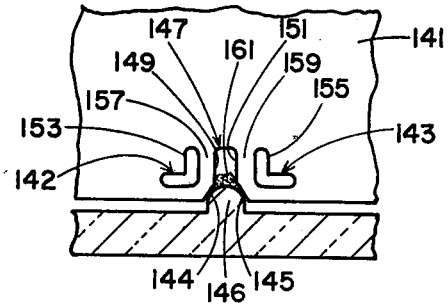

FIG. 10 illustrates an important embodiment having features not found in the above-described embodiments. FIG. 10 illustrates a mask suspension device comprising a skirt corner portion 141 having formed therein a pair of "L"-shaped slits 142, 143 which embrace a notch 147 formed in the skirt corner portion 141.

The notch 147 has angled edge elements 144, 145 which make referencing engagement with a boss 146 on the faceplate in the manner described above. The notch 147 also has, however, an enlarged portion, here shown as being of rectangular shape. The parallel sides 149, 151 of the enlarged portion of the notch 147 and the legs 153, 155 of the slits 142, 143 define resilient strip-like sections 157, 159 which are axially oriented and thus provide maximum stiffness in the tube's axial direction.

The enlarged portion of the notch 147 provides additional space for the cement 161 to collect, thus reducing the possibility that the cement might collect on the resilient strip-like sections 157, 159 and reduce their ability to flex. If such were to happen, the radial compliance of the mask corner portion would be reduced. It should be understood that the teachings of this embodiment may be incorporated in other embodiments described herein, such as the preferred FIGS. 1–3 embodiment.

Figure 11:
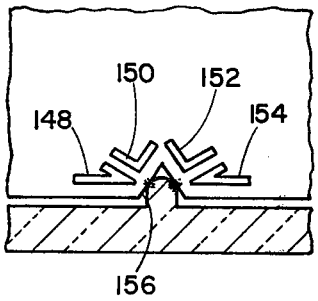

FIG. 11 illustrates yet another embodiment in which the desired high radial compliance is provided by a pattern of four angled slits 148, 150, 152 and 154. The pattern of slits is designed to form a pair of T-shaped, resilient, strip-like sections, one on each side of a V-notch 156. By selecting the size, spacing and configuration of the slits 148-154, the desired degree of resilience in each of the strip-like sections can be achieved.

Figure 12:
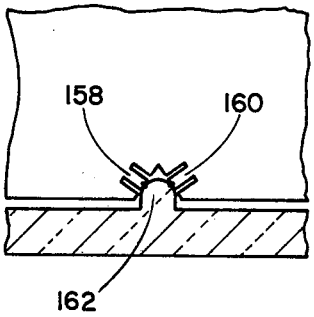

Yet another embodiment, illustrated in FIG. 12, can be seen to resemble somewhat the FIGS. 4–5 embodiment in that slits extending inwardly from the free edge of the mask corner portion define a pair of cantilever blades 158, 160. The blades are cemented to the boss 162 at their points of engagement therewith. By adjusting the spacing and length of the slits, the desired high radial compliance in the corner portion of the mask and the desired high axial and angular stiffness can be provided.

Figure 13:
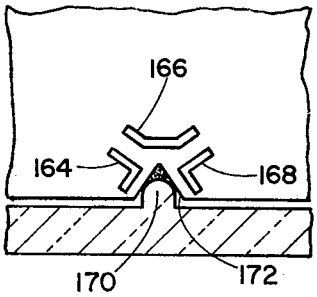

FIG. 13 depicts an embodiment in which a pattern of apertures 164, 166, 168 define an "X" shaped, resilient strip-like section providing the desired high radial compliance. FIG. 13 also teaches that the mask corner portion need not be affixed to the raised glass element at the points of its engagement therewith. In the FIG. 13 embodiment the mask corner portion is cemented to the boss 170 at the bottom of the notch 172, rather than at the points of engagement between the notch and the boss 170. The point or points at which the mask corner portion is secured to the boss (or other modification of the faceplate) should be close enough to the points of engagement therewith, however, that upon thermal expansion or contraction of the mask no slippage between the mask and the faceplate results.

Figure 14:
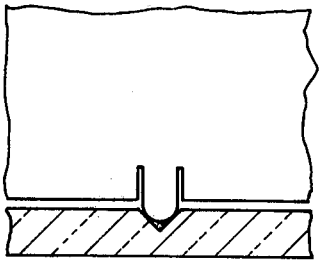

FIG. 14 is another embodiment utilizing the principles described above with respect to FIGS. 4–5.

Figure 15:
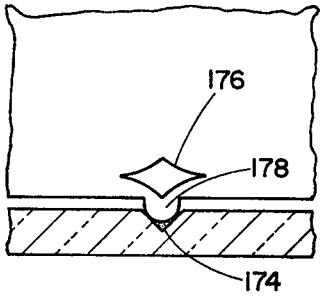

FIG. 15 teaches that in an embodiment wherein the modification of the faceplate is a radial groove 174, nevertheless one or more apertures may be formed in the mask corner portion, here shown as a single aperture 176 which creates one or more strip-like sections providing the desired high radial compliance while establishing a high degree of axial and angular stiffness. In FIG. 15 a single strip-like section is shown at 178.

Figure 16:
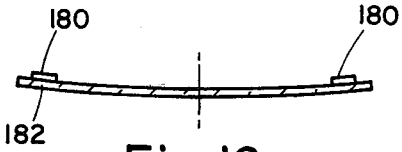
FIGS. 16 and 17 illustrate two alternative face-plate modifications useful in carrying out this invention.
Figure 17:
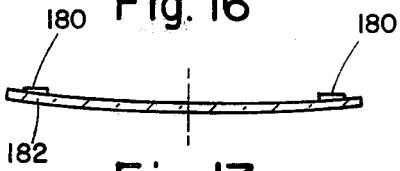

In any of the above-described embodiments or any other embodiment executing the teachings of this invention which employs three or four bosses extending from the concave inner surface of the faceplate, the ridge of the boss may have a peak which is parallel to the concave inner surface of the faceplate, as shown in FIG. 16, or the peak may be perpendicular to the central axis of the faceplate, as shown in FIG. 17, or may have any desired angle between these limits. In FIGS. 16 and 17 the ridges are shown at 180 and the faceplates are designated 182.

It is believed that the controlling factor as to the particular chosen angle of the ridge peak relative to the inner surface of the faceplate is as follows. An angle should be selected which will place the ridge peak at approximately 90° to the engaging mask suspension element. With the engaging mask suspension element approximately perpendicular to the engaged ridge, the maximum degree of axial stiffness will result.

Whereas in each of the above-described embodiments, cement has been suggested as the means for immovably holding the mask suspension elements on the integral faceplate modifications, it is contemplated that a spring-type hold-down system along the general lines suggested in the above-discussed Knochel et al. or Fyler patents might be employed. It is imperative to understand, however, that unlike the Knochel et al. or Fyler hold-down schemes, any spring hold-down arrangement used in any embodiment of this invention must immovably hold the mask corner portion on the integral modification of the faceplate. As described in detail above, no relative sliding movement between the mask and faceplate can be tolerated in any system executing the present invention.

Each of the above-described embodiments shows the integral modification of the faceplate as defining radially extending, axially convergent engagement surface areas adapted to make a two-point engagement with a corner portion of a shadow mask. It is contemplated that the radially extending, axially convergent engagement surface areas could alternatively be provided on the mask, preferably as an integral formation therein, with the faceplate having merely a rounded protuberance for making two-point engagement with the said mask formation. Such an embodiment would resemble somewhat an arrangement shown in the afore-discuss Fyler patent, at least to the extent that both arrangements would have V-channel structures on the mask which make two-point engagements with integral faceplate protuberances. However, again, it is critically important to understand that in such an alternative arrangement, the mask be held immovably against relative movement on the protuberance. The reasons for this are detailed above.

Whereas in the preferred embodiments described above, the mask suspension elements are formed integrally in a skirt portion of the shadow mask, it is contemplated that other embodiments of the invention may have mask suspension element structures as taught above, but not necessarily formed integrally from a mask skirt structure.

It is a stated object to provide a mask suspension system capable of meeting the stated requirements, yet one which is also of reduced cost. It can be seen that the cost of the mask suspension system in the aforedescribed embodiments is remarkably low. The integral faceplate modifications are realized at very little or no cost. Also, since the mask suspension elements are formed integrally in the mask skirt, they too are obtained at little or no cost. Other aperture configurations and patterns selected to achieve the aforestated objectives may also be employed in embodiments of the present invention. It should be understood, of course, as a general statement, that various alternative structures suggested for certain of the embodiments described herein are equally applicable to other described embodiments.

Numerous other alterations, modifications and variations may be employed within the spirit and scope of the present invention and I therefore intend that the following claims embrace all such.

What is claimed is:

1. In a color cathode ray tube, the combination comprising:

an approximately rectangular faceplate supporting on a concave inner surface thereof in a central region a phosphor screen comprising a pattern of red-emissive, blue-emissive and green-emissive phosphor element triads;

a lightweight, approximately rectangular shadow mask having a central portion which has a curvature related to the curvature of said faceplate inner surface and which contains a pattern of electron-transmissive apertures registerable with said pattern of phosphor triads, said mask having means providing substantial rigidity with respect to axes normal to the sides thereof, but providing for flexure of the mask with respect to its diagonals; and a mask suspension system for establishing a predetermined spatial position of said mask relative to said inner surface of said faceplate, comprising four suspension means for mechanically coupling said mask to said faceplate, said suspension means being located one at each corner of the mask to permit the mask to flex about said diagonals and conform to the contour of the faceplate, all four of said suspension means having means effecting a predetermined spacing of the mask from said inner surface of said faceplate, three of said four suspension means also effecting an angularly rigid and precise coupling of said mask to said faceplate, said combination being characterized by:

each of said three suspension means comprising an integral modification of said faceplate inner surface which defines two angularly spaced, axially convergent engagement surface areas, said mask having in each of three corner portions associated with said three suspension means, corner-located means for making angularly retentive, two-point engagement with said two angularly spaced engagement surface areas on one of said modifications of said faceplate, the resultant six-point engagement of said three corner-located means with said three integral modifications of said faceplate effecting said angularly rigid and precise coupling of said mask to said faceplate, said combination including means for immovably holding on said faceplate said three corner-located means and a corner-located means on a fourth corner portion of the mask when said tube is assembled — including during thermal expansion and contraction of the mask, and said mask corner portions each having means for providing high radial compliance therein such that upon thermal expansion of said mask, any radial loads imposed on the mask corners are purely radial and of insufficient magnitude to significantly deform the mask.

2. The apparatus defined by claim 1 wherein said mask has an integral, radially outwardly and forwardly extending skirt, and wherein said corner-located means are formed integrally in corner portions of said skirt.

3. The combination defined by claim 2 wherein in said corner portions of said skirt, said skirt is formed such that a free edge thereof meets the engaging faceplate surface at approximately 90°.

4. The apparatus defined by claim 2 wherein said high radial compliance is provided by structurally weakening said skirt corner portions.

5. The combination defined by claim 4 wherein said skirt corner portions have mask material removed therefrom to effect said structural weakening thereof.

6. The combination defined by claim 5 wherein said skirt corner portions each include at least one resilient, strip-like section having as one side edge a free edge of the skirt corner portion which is immovably held against said faceplate and having as the opposed side edge a boundary of an opening formed in the skirt corner portion, whereby upon thermal expansion of said mask, said strip-like section, being immovably held on the faceplate, flexes to produce said high radial compliance in said mask corner portions.

7. The combinations defined by claim 5 wherein said modification of said faceplate is a radial, embossed ridge, wherein said skirt corner portions in said three mask corners each define a V-shaped notch in a free edge of the mask corner which engages said ridge, and wherein said three skirt corner portions each defines an opening adjacent each edge of the "V" to create a resilient strip-like section along each side of the "V" which produces said radial compliance in said mask corner portions.

8. The combination defined by claim 5 wherein said modification of said faceplate is a radial V-shaped groove in said faceplate, wherein said skirt corner portions in said three mask corners each define an extension of the free edge of said skirt corner portion adapted to make two-point referencing engagement with an associated one of said grooves when the mask is mounted on the faceplate, and wherein said skirt corner portion has an opening adjacent the free edge of said extension such that said extension is resilient and provides the said radial compliance in said corner portion.

9. The combination defined by claim 5 wherein said modification of said faceplate is a radial, embossed ridge, wherein said skirt corner portion in each of said three mask corners defines a notch in a free edge of the skirt corner portion having angled side portions which make said two-point engagement with said modification of said faceplate, wherein said means for immovably holding said mask corners on said modifications constitutes a quantity of cement in said notch, and wherein said notch has at its base an enlarged portion to provide space to accommodate excess cement.

10. The combination defined by claim 9 wherein said skirt corner portions each include a resilient, strip-like section on each side of said notch, each section having as one side a side of said enlarged portion of said notch and having as the opposed side edge a boundary of a slit formed in the skirt corner portion, whereby upon thermal expansion of said mask, said strip-like section, being immovably cemented to said modification, flexes to produce said high radial compliance in said mask corner portions.

11. The combination defined by claim 1 wherein said modifications of said faceplate each constitute radial grooves in said faceplate.

12. The combination defined by claim 11 wherein said faceplate has grooves in each of three corners.

13. The combination defined by claim 1 wherein said modification of said faceplate each constitute radial embossed ridges.

14. The combination defined by claim 13 wherein said ridges each have a peak parallel to the faceplate inner surface.

15. The combination defined by claim 13 wherein said ridges each have a peak which is perpendicular to the central axis of the faceplate.

16. The combination defined by claim 13 wherein said faceplate has a ridge in each corner, wherein in three of said mask corner portions associated with said three suspension means, a V-shaped notch suitable for making angularly retentive engagement with a respectively associated ridge is formed in a free edge of the mask corner portion, and wherein in the fourth mask corner portion, the free edge is configured to sit on the ridge while being free to take an angular position dictated by the mask suspension means in the remaining three corners.

17. The combination defined by claim 2 wherein said skirt corner portions in each of three mask corners associated with said three mask suspension means has a knife-like free edge defining two angularly spaced edge elements for making two-point engagement with the engagement surface areas on a mated faceplate modification.

18. The combination defined by claim 17 wherein said skirt corner portions have mask material removed therefrom to effect said radial compliance therein.

19. The combination defined by claim 18 wherein said skirt corner portions each have an aperture pattern formed therein which is so configured and arranged as to effect said radial compliance.

20. The combination defined by claim 5 wherein said skirt corner portions each have at least one pair of angularly spaced slits, extending inwardly from a free edge of said skirt to effect said radial compliance.

21. The combination defined by claim 1 wherein said mask suspension elements are each cemented to said faceplate.

22. In a color cathode ray tube, the combination comprising:

an approximately rectangular faceplate supporting on a concave inner surface thereof in a central region a phosphor screen comprising a pattern of red-emissive, blue-emissive and green-emissive phosphor element triads;

a lightweight, approximately rectangular shadow mask having a central portion which has a curvature related to the curvature of said faceplate inner surface and which contains a pattern of electron-transmissive apertures registerable with said pattern of phosphor triads, said mask having means providing substantial rigidity with respect to axes normal to the sides thereof, but providing for flexure of the mask with respect to its diagonals; and a mask suspension system for establishing a predetermined spatial position of said mask relative to said inner surface of said faceplate, comprising four suspension means for mechanically coupling said mask to said faceplate, said suspension means being located one at each corner of the mask to permit the mask to flex about said diagonals and conform to the contour of the faceplate, all four of said suspension means having means effecting a predetermined spacing of the mask from said inner surface of said faceplate, three of said four suspension means effecting an angularly rigid and precise coupling of said mask to said faceplate, said combination being characterized by:

each of said three suspension means comprising an integral radial modification of said faceplate inner surface which defines two angularly spaced, axially convergent engagement surface areas, said mask having an integral, outwardy and forwardly extending skirt which gives rigidity to the mask and shields overscanned and stray electrons, said mask skirt having in each of three corner portions associated with said three suspension means corner-located means for making angularly retentive, two-point engagement with said two angularly spaced engagement surface areas on one of said modifications of said faceplate, the resultant six-point engagement of said three mask elements with said three integral modifications of said faceplate effecting said angularly rigid and precise coupling of said mask to said faceplate, said combination including cement for immovably holding on said faceplate said three corner-located means and a fourth corner-located means on a fourth corner portion of said skirt when said tube is assembled, said corner-located means being located on said skirt corner portions symmetrically with respect to a mask diagonal, and said skirt corner portions each including at least one resilient strip-like section having as one side edge a free edge of the skirt corner portion and having as the opposed side edge a boundary of an opening formed in the skirt corner portion, said strip-like section causing said skirt corner portion to have high radial compliance such that upon thermal expansion of said mask, any radial loads imposed on the mask corners are purely radial, along a diagonal, and of insufficient magnitude to significantly deform the mask.

23. The apparatus defined by claim 22 wherein said modification of said faceplate is a radial, embossed ridge, wherein said corner-located means in said three skirt corner portions each define a V-shaped notch in the free edge of the mask skirt which engages said ridge, and wherein said skirt corner portion defines an opening adjacent each edge of the "V" to create a resilient strip-like section along each side of the "V".

24. The apparatus defined by claim 23 wherein said corner-located means is cemented to said ridge.

25. The combination defined by claim 23 wherein said ridge is arcuate in cross-section.

26. The combination defined by claim 22 wherein said three skirt corner portions each have a knife-like free edge defining two angularly spaced edge elements for making two-point engagement with the engagement surface areas on a mated faceplate modification.

27. The combination defined by claim 22 wherein at the fourth corner of the mask, said faceplate has no modification, but said mask has an integral skirt corner portion which defines a fourth corner free edge whose spatial position is so related to said corner-located means on the remaining three mask corners as to maintain a prescribed spacing between the mask and the faceplate, all four corner-located means being cemented to the faceplate when the mask and faceplate are assembled.

* * * * *